US007867368B2

(12) United States Patent
Ogawa et al.

(10) Patent No.: US 7,867,368 B2
(45) Date of Patent: Jan. 11, 2011

(54) PLATING APPARATUS

(75) Inventors: Yoshimitsu Ogawa, Sayama (JP); Hajime Miyasaka, Sayama (JP)

(73) Assignee: Honda Motor Co., Ltd., Tokyo (JP)

( * ) Notice: Subject to any disclaimer, the term of this patent is extended or adjusted under 35 U.S.C. 154(b) by 1063 days.

(21) Appl. No.: 11/570,568

(22) PCT Filed: May 10, 2005

(86) PCT No.: PCT/JP2005/008847

§ 371 (c)(1),
(2), (4) Date: Dec. 13, 2006

(87) PCT Pub. No.: WO2005/123989

PCT Pub. Date: Dec. 29, 2005

(65) Prior Publication Data

US 2008/0047829 A1 Feb. 28, 2008

(30) Foreign Application Priority Data

Jun. 16, 2004 (JP) ..... 2004-178837
Jun. 16, 2004 (JP) ..... 2004-178927

(51) Int. Cl.
*C25D 5/02* (2006.01)
*C25D 5/08* (2006.01)
*C25D 17/00* (2006.01)

(52) U.S. Cl. ..... 204/272; 205/131; 204/275.1; 204/277

(58) Field of Classification Search ..... 205/131
See application file for complete search history.

(56) References Cited

U.S. PATENT DOCUMENTS 4,279,706 A * 7/1981 Blanc et al. ..... 205/101
4,345,977 A * 8/1982 Blanc et al. ..... 205/131
4,853,099 A * 8/1989 Smith ..... 204/224 R
5,516,417 A * 5/1996 Kondou et al. ..... 205/109
5,540,829 A * 7/1996 Mase et al. ..... 205/109
5,620,575 A * 4/1997 Karasawa et al. ..... 204/272
5,660,704 A * 8/1997 Murase ..... 205/109
5,865,962 A * 2/1999 Ikegaya ..... 204/224 R
2003/0079996 A1* 5/2003 Nozaki et al. ..... 205/122
2004/0211672 A1* 10/2004 Ishigami et al. ..... 205/131

FOREIGN PATENT DOCUMENTS

JP 56-40148 4/1981
JP 63-206496 8/1988

(Continued)

*Primary Examiner*—Harry D Wilkins, III
(74) *Attorney, Agent, or Firm*—Rankin, Hill & Clark LLP

(57) ABSTRACT

A plating apparatus has a tubular electrode (16) placed in a hollow section (12) of work (11). The tubular electrode (16) has a through-hole (16*a*) formed in the longitudinal direction. A circular tube-like gap (S1) in which a plating liquid (17) flows is formed between the tubular electrode placed in the hollow section and an inner peripheral wall (14) of the hollow section. The plating liquid flows spirally from the lower end of the gap to the upper end by action of a vortex producing flow path (29) communicating to the lower end of the gap. The plating liquid having reached the upper end circulates through the through-hole of the tubular electrode.

5 Claims, 13 Drawing Sheets

FOREIGN PATENT DOCUMENTS

| | | |
|---|---|---|
| JP | 02-015193 | 1/1990 |
| JP | 04-000400 | 1/1992 |
| JP | 07-118891 | 5/1995 |
| JP | 07-157897 | 6/1995 |
| JP | 08-261055 | 10/1996 |

* cited by examiner

PLATING APPARATUS

TECHNICAL FIELD

The present invention relates to a plating apparatus whereby a plated coating is formed on an inner circumferential wall of a hollow region of a workpiece such as a cylinder.

BACKGROUND ART

A known method for forming a plated coating on an inner circumferential wall of a cylinder is a high-speed plating method in which a plated coating is formed on an inner circumferential wall of a cylinder at a high speed by the forced flow of a plating liquid along the inner circumferential wall of the cylinder (e.g., JP-A-07-118891).

The conventional plating apparatus and plated coating formed by this apparatus are described in reference to FIGS. 12, 13*a*, and 13B.

In FIG. 12, a support block 202 is attached to a stand 201 of a plating apparatus 200, and a cylindrical electrode 203 is attached to the support block 202. In this condition, an outflow channel 205 for the cylindrical electrode 203 and an outflow channel 204 for the support block 202 are arranged concentrically.

A cylinder block 207 is placed on the support block 202 in a condition whereby the block has been inverted top to bottom (e.g., in a condition in which the crankcase 208 is upwards), and the cylindrical electrode 203 is disposed inside the cylinder 209.

A channel 211 is formed in the gap between an inner circumferential wall 209*a* of the cylinder 209 and the cylindrical electrode 203. The channel 211 connects with an introduction channel 212 of the support block 202.

An opening 209*b* of the cylinder 209 (opening on the side of the crank shaft) is closed off with a lid 214. A bottom end of a rod 215 is connected to this lid 214, and the rod 215 extends upwards. An upper end of the rod 215 is supported by a support plate 216. The support plate 216 is a member that is carried on the upper end of the cylinder block 207.

By supplying a plating liquid to the introduction channel 212 in this condition, the plating liquid is caused to flow from the introduction channel 212 as indicated by the arrow A into the channel 211 between the cylindrical electrode 203 and the inner circumferential wall 209*a* of the cylinder 209.

The plating liquid that reaches the upper end portion of the cylindrical electrode 203 is guided by the lid 214 and caused to flow into the outflow channel 205 in the cylindrical electrode 203 as indicated by the arrow B. The liquid then flows from the outflow channel 205 into the outflow channel 204 of the support block 203 as indicated by the arrow C.

In this manner, the plating liquid is forced to flow along the inner circumferential wall 209*a* of the cylinder 209, thereby rapidly forming a plated coating 218 on the inner circumferential wall 209*a* (refer to FIG. 13A).

The gap between the cylindrical electrode 203 and the inner circumferential wall of the cylinder 209, i.e., the channel 211, is formed as a cylinder which is comparatively narrow. Consequently, when the plating liquid is supplied to the cylindrical channel 211 as indicated by the arrow A, the plating liquid does not easily flow uniformly throughout the interior of the cylindrical channel 211. For this reason, a uniform plated coating 218 is difficult to form on the inner circumferential wall 209*a* of the cylinder 209, and increases in productivity are impeded, leaving room for improvement.

The plated coating formed by the aforementioned high-speed plating apparatus will be described next.

In FIG. 13A, the cylinder 209 is closed off by an external circumferential part 214*a* when the lid 214 seals the inner circumferential wall 209*a* of the cylinder 209. Thus, the plating liquid that flows along the inner circumferential wall 209*a* of the cylinder 209 up to the upper end 203*a* of the cylindrical electrode 203 strikes the lid 214 and enters into the outflow channel 205 in the cylindrical electrode 203 as indicated by the arrow B.

For this reason, the plating liquid is stirred comparatively effectively in the vicinity of the external circumferential part 214*a* of the lid 214. Thus, the plated coating 218 assumes a condition in which the coating runs along the outer circumferential part 214*a* of the lid 214 and protrudes towards the center of the cylinder 209, thereby forming flash 218*b* at the boundary 218*a* of the plated coating 218.

In FIG. 13B, the surface of the plated coating 218 is honed to the finished surface position 221 indicated by the broken line, and the inside diameter of the plated coating 218 (i.e., the inside diameter of the cylinder 209) is formed at the prescribed size.

Because flash 218*b* is formed at the boundary 218*a* of the plated coating 218, an excessive load is placed on the flash 218*b* during honing. Consequently, there is the danger that the plated coating 218 will separate from the inner circumferential surface 209*a* at the boundary 218*a*, which is an impediment to productivity increase.

The plating apparatus 200 shown in FIG. 12 has, as essential members, a support plate 216, a rod 215, and a lid 214, whereby the opening 209*b* of the cylinder 209 is closed off by the lid 214.

Moreover, regarding the outer circumferential part 214*a* of the lid 214 (refer to FIG. 13A), an O-ring (not shown in the figures) is necessarily provided on the outer circumferential part 214*a* of the lid 214 in order to seal the inner circumferential wall 209*a* of the cylinder 209. In addition, the structure of the lid 214 is complicated because the bottom end of the rod 215 is attached to the lid 214.

Moreover, the rod 215 must extend to the upper end of the cylinder block 207, and the rod 215 is therefore comparatively long. Moreover, the support plate 216 is made comparatively large so that the support plate 216 that supports the upper end of the rod 215 can be placed on the top end of the cylinder block 207.

For this reason, the plating apparatus 200 has a large number of parts, and the plating apparatus 200 is also large. Consequently, reduction in equipment costs is difficult to achieve.

In addition, when the opening 209*b* of the cylinder 209 is closed by the lid 214, the lid 214 must be moved from the upper opening 219 of the cylinder block 207 to the opening 209*b* of the cylinder 209. Consequently, it is not possible to use the plating apparatus 200 for workpieces that do not have an upper opening 219 as with the cylinder block 207 (e.g., a cylinder block with an integrated cylinder head).

Specifically, with the plating apparatus 200, utilization is restricted based on workpiece shape, and thus there is room for improvement in this regard.

DISCLOSURE OF THE INVENTION

According to the present invention, there is provided a plating apparatus for forming a plated coating on an inner circumferential wall of a hollow region of a hollow workpiece, the apparatus comprising a cylindrical electrode that has a longitudinal through-hole and can be disposed so that a cylindrical gap is formed inside the hollow region of the workpiece; and a means for forming a helical flow of a plating liquid from a bottom end to a top end of the cylindrical gap when the plating liquid flows into the cylindrical gap communicating with the through-hole via the end portion of the cylindrical electrode.

Because the plating liquid thus flows helically from the bottom end to the top end of the cylindrical gap, stirring of the plating liquid is increased and uniform flow of the plating liquid can occur in the cylindrical gap. As a result, a plated coating can be formed at a uniform thickness over the entire inner circumferential wall of the hollow region.

Preferably, the plating apparatus further comprises a supply channel for supplying a plating liquid through to a bottom end of the cylindrical gap; a porous member having a plurality of holes provided between the supply channel and the bottom end of the gap; air supply means provided in the supply channel; and air being supplied to the supply channel by the air supply means, whereby bubbles are admixed in the plating liquid in the supply channel, and the plating liquid with admixed air bubbles is conducted to the cylindrical gap via the porous member.

Thus, air is supplied to the supply channel, causing admixture of bubbles in the plating liquid inside the supply channel. The plating liquid with admixed bubbles is then conducted into the cylindrical gap via a porous member, thereby adjusting the bubbles to a uniform size. Consequently, smooth movement of the bubbles in the plating liquid is facilitated, allowing the plating liquid to be stirred by the bubbles. The plated coating is thereby formed at a thickness having a higher degree of uniformity over the entire inner circumferential wall of the hollow region.

Moreover, the plating liquid passes through a porous member, whereby the plating liquid is dispersed by this porous member, and the flow of the plating liquid is rendered uniform. Consequently, the plating liquid is conducted uniformly over the entire inner circumferential wall of the hollow region, and the plated film is formed at a uniform thickness.

Desirably, the plating apparatus further comprises a shielding member formed from an insulating material provided at an upper end of the hollow region of the workpiece, and a gap for introducing a plating liquid whereby the plating liquid can be introduced between the inner circumferential wall of the hollow region and the shielding member.

By thus providing a shielding member, the flow of the plating liquid upwards from the plating treatment surface is inhibited by the shielding member. Consequently, a plated coating can be reliably formed on the plating treatment surface. Moreover, because a gap for introducing a plating liquid is formed between the inner circumferential wall of the hollow region and the outer circumference of the shielding member, the plating liquid can be conducted through the gap. In addition, because the shielding member is formed from an insulating member, it is possible to gradually decrease the electric current flowing into the gap. Consequently, because the electric current flowing into the gap for introducing a plating liquid is gradually decreased along with introduction of the plating liquid into the gap, it is possible to gradually inhibit the amount of plating component in the plating liquid that adheres to the inner circumferential wall.

As a result, a plated coating can be reliably formed on the surface to be plated, and because the thickness of the plated coating gradually decreases at the plated coating boundary regions, an adequate plated coating can be formed. By this means, it is possible to prevent separation of the plated coating from the boundary regions when machining the plated coating surfaces.

Preferably, the bottom part of the outer circumferential end of the shielding member is disposed in proximity to the boundary position between a surface to be plated with the plated coating and a surface above the surface to be plated, and the gap for introducing a plating liquid is set to 0.25 to 5 mm.

If the gap for introducing a plating liquid is less than 0.25 mm, then the gap will be too small, and it will be difficult for the plating liquid to be conducted into the gap. If the plating liquid is not conducted into the gap for introducing the plating liquid, this will be equivalent to a condition in which the external circumference of the shielding member contacts the inner circumferential wall, and there is the danger that flash will occur at the boundary regions of the plated coating, as described in regard to the prior art. If, on the other hand, the gap for introducing a plating liquid is less than 0.25 mm, this will be problematic from the standpoint of jig precision, and there is the danger that the external circumference of the shielding member will contact the inner circumferential wall. Consequently, the gap for introducing a plating liquid is set at 0.25 mm, which prevents the generation of flash at the boundary regions of the plated coating, while also preventing contact of the external circumference of the shielding member and the inner circumferential wall during attachment of the shielding member.

If the gap for introducing a plating liquid exceeds 5 mm, the gap will be too large, and there is the danger that the plating liquid will flow out from the gap. When the plating liquid flows out from the gap, the liquid often adheres to regions that are not to be plated. Moreover, the electric current density above the regions to be plated decreases, and the plating thickness in these regions decreases as well. As a result, the gap for introducing a plating liquid is restricted to 5 mm or less, thereby preventing outflow of the plating liquid from the gap.

The shielding member is preferably attached to the cylindrical electrode.

Among workpieces, there are those in which both ends of the hollow region are open, as with the workpieces discussed in the prior art, as well as those in which only one end of the hollow region is open, as with the workpieces presented in the examples. With workpieces in which both ends of the hollow section are open, the upper end of the hollow region is open during placement of the workpiece in the plating device. For this reason, it is possible for the shielding member to pass through the opening at the upper end from above the workpiece, and to be thereby disposed at the prescribed position. However, with workpieces in which only one end of the hollow region is open, the top end of the hollow region is closed off when the workpiece is placed in the plating apparatus. For this reason, the shielding member cannot be disposed at the prescribed position from above the workpiece.

Consequently the shielding member is attached to the cylindrical electrode, and the plating apparatus thus can be used with workpieces in which only one end of the hollow region is open. Utilization is thus not restricted by the workpiece shape, and a dramatic increase in the range of applications is achieved.

Because the shielding member restricts the flow of the plating liquid, it is normally provided in the vicinity of the cylindrical electrode. Thus, because the shielding member is attached to the cylindrical electrode, it is possible to make the apparatus more compact and to simplify the member used for attaching the shielding member, thereby reducing equipment costs.

BEST MODE FOR CARRYING OUT THE INVENTION

Figure 1:
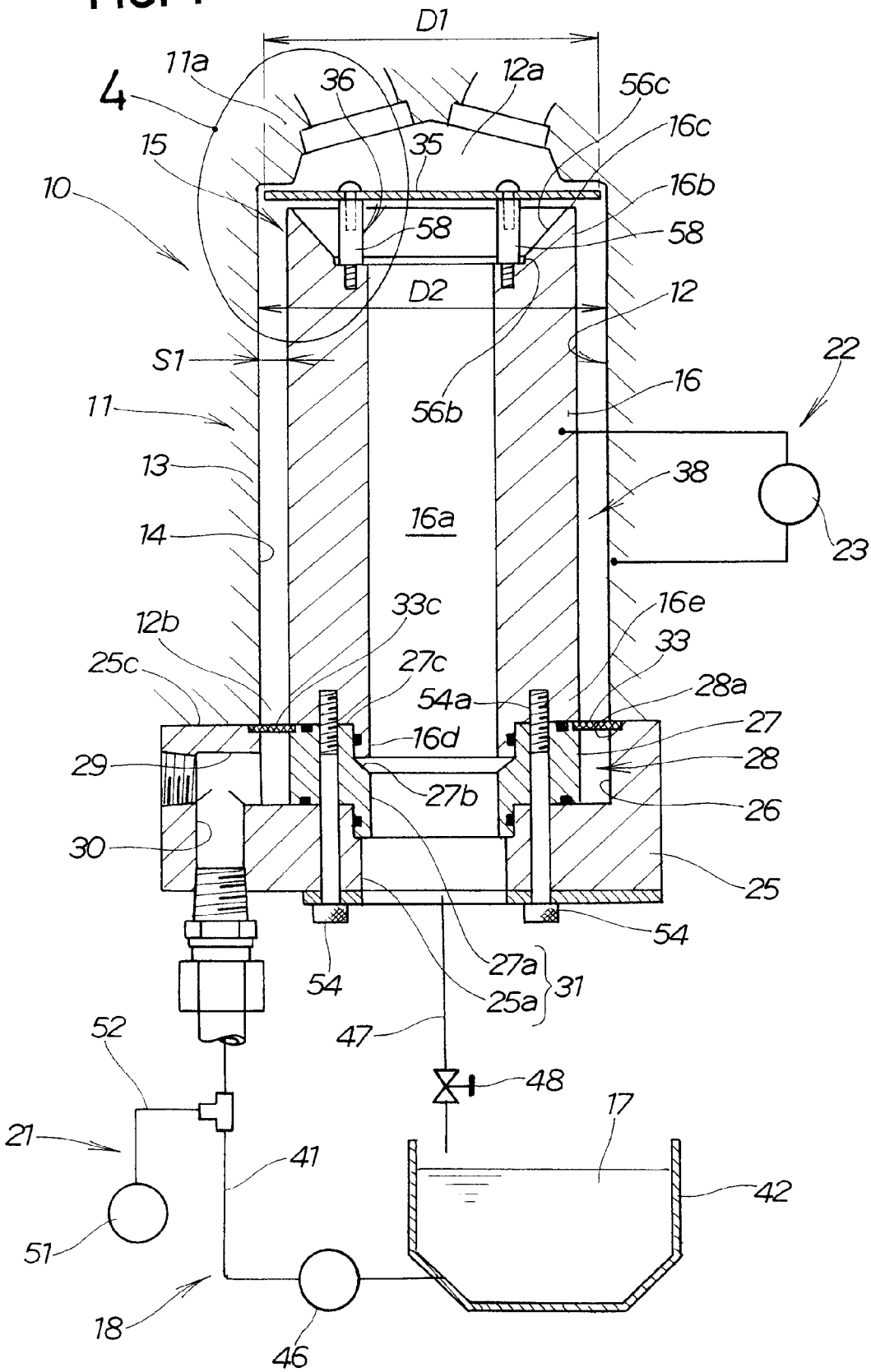
FIG. 1 is a sectional view showing a plating apparatus according to a first embodiment of the present invention.

The plating apparatus 10 of the first embodiment shown in FIG. 1 has an electrode unit 15 in which a cylindrical electrode 16 is disposed in a hollow region 12 (refer also to FIG. 5) of a cylinder block (workpiece) 11; plating liquid supply means 18 for supplying a plating liquid 17 to the electrode unit 15; air supply means 21 for supplying air to the plating liquid 17; and electric current supply means 22 for causing an electric current to flow between a cylinder 13 and the cylindrical electrode 16.

The cylinder block 11 has a cylindrical cylinder 13. The hollow region 12 is formed by the inner circumferential wall 14 of the cylinder 13. This cylinder block 11 is a workpiece in which the cylinder 13 and cylinder head part 1 la are formed as an integrated body, and the upper end 12*a* of the hollow region 12 is substantially sealed off by a cylinder head 11*a*.

The cylindrical electrode 16 is attached above the inner member 27 disposed in a depression 26 of a support block 25. A ring-shaped introduction channel 28 is formed by the inner member 27 and the depression 26. The introduction channel 28 connects with a pair of vortex-creating channels 29, 29 (refer to FIG. 3). These vortex-creating channels 29, 29 connect with connection channels 30, 30. An outflow channel 31 is formed by a though-hole 27*a* in the inner member 27 and a through-hole 25*a* in the support block 25. An upper end 28*a* of the introduction channel 28 is covered with a porous member 33. A through-hole 16*a* formed in the cylindrical electrode 16 connects with the outflow channel 31. The shielding plate (shielding member) 35 is attached above an upper end 16*b* of the cylindrical electrode 16 via attachment means 36.

The cylinder block 11 is mounted on the support block 25. The cylindrical electrode 16 is disposed so that a gap (cylindrical gap) S1 with respect to the hollow region 12 is formed inside the hollow region 12 of the cylinder block 11. The gap S1 forms a cylindrical plating channel 38. The plating channel 38 connects with the introduction channel 28 via the porous member 33. The through-hole 16*a* of the cylindrical electrode 16 is disposed on the same axis as the outflow channel 31.

Figure 3:
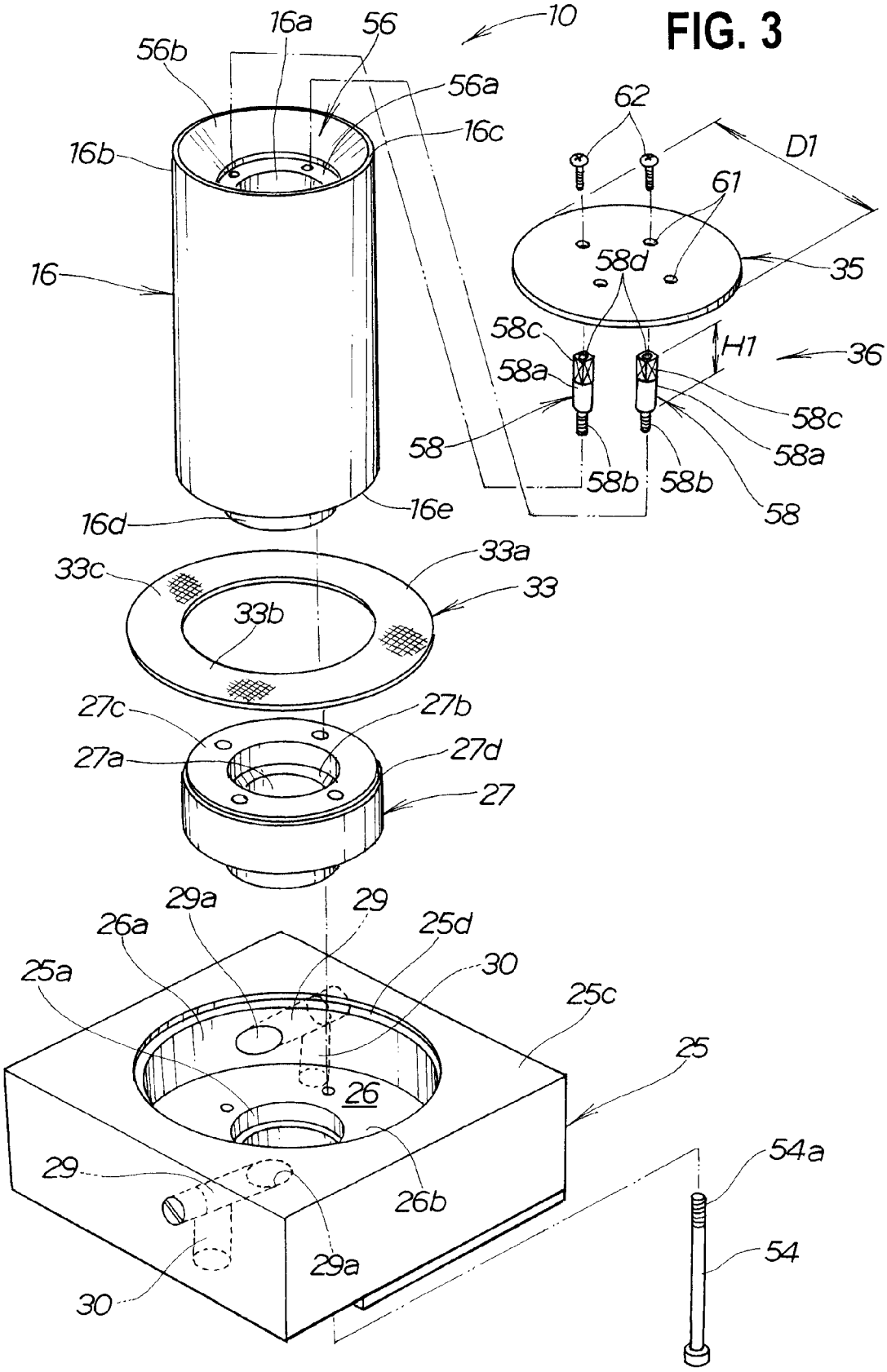
FIG. 3 is an exploded perspective view of the electrode unit shown in FIG. 2.

The plating liquid supply means 18 supplies the plating liquid 17 in a tank 42 to the connection channels 30, 30 formed in the support block 25 via a supply channel 41 (refer to FIG. 3). Air supply means 21 and a supply pump 46 are provided along the supply channel 41. The outflow channel 31 connects with the tank 42 via a return channel 47. A control valve 48 is provided along the return channel 47.

The air supply means 21 drives an air supply source 51 and supplies air to the supply channel 41 via an air supply channel 52.

In the electric current supply means 22, the positive electrode of a current supply source 23 is connected to the cylindrical electrode 16, and the negative electrode is connected to the cylinder 13 to supply electric current.

The control valve 48 is a valve for adjusting the liquid surface height of the plating liquid 17. The plating liquid 17 is described herein using an example of a composite plating liquid produced by admixing ceramic particles into a plating liquid. A plating liquid used for nickel plating is another example of a plating liquid.

Figure 2:
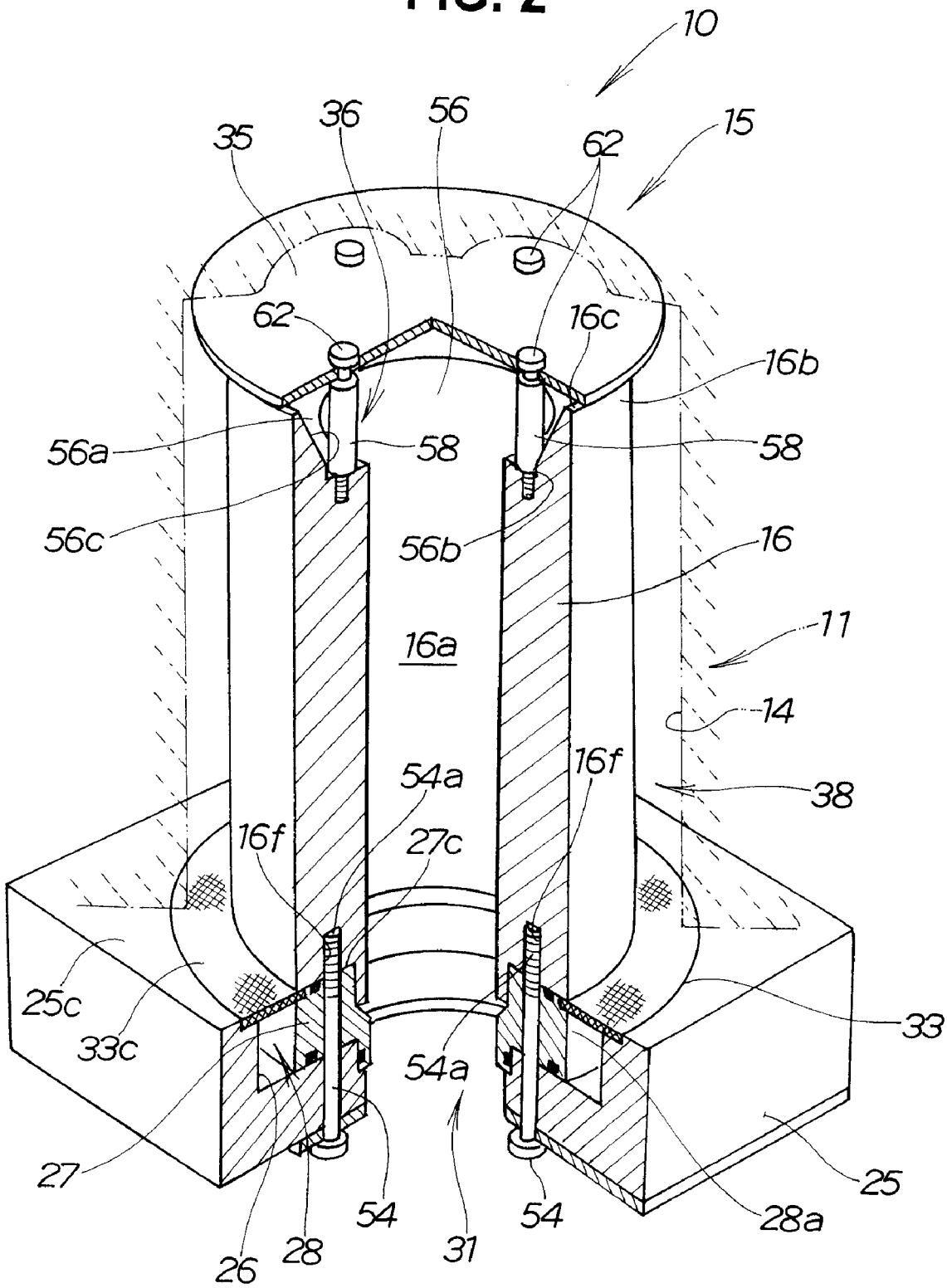
FIG. 2 is a partial sectional perspective view showing the electrode unit shown in FIG. 1.

FIG. 2 shows the electrode unit 15 shown in FIG. 1.

The ring-shaped introduction channel 28 is formed from an inner member 27 and a depression 26. The open upper end 28*a* of the introduction channel 28 is covered with the ring-shaped porous member 33. The cylindrical electrode 16 is attached with a plurality of bolts 54 to the support block 25 via the inner member 27. In this condition, the through-hole 16*a* formed on the cylindrical electrode 16 is disposed on the same axis as the outflow channel 31.

The cylindrical electrode 16 has a horizontal flat step 56*a* on the upper end 16*b* of the inner circumferential region 56 thereof, and also has an inclined surface 56*c* that gradually increases in diameter from the outer circumferential end 56*b* of the step 56*a* toward the upper edge 16*c*. A shielding plate 35 is affixed to the step 56*a* via the attachment means 36.

FIG. 3 shows the electrode unit 15 in an exploded perspective view.

The support block 25 has a depression 26 in the center region. The circumferential wall 26*a* in which the depression 26 is formed is circular. The pair of vortex-producing channels 29, 29 is formed at a spacing of 180° parallel to a tangent to this circumferential wall 26*a*. Supply openings 29*a*, 29*a* of these vortex-producing channels 29, 29 each open onto the circumferential wall 26*a*.

Thus, the plating liquid 17 is supplied along the circumferential wall 26*a* of the depression 26 from the supply openings 29*a*, 29*a* of the vortex-producing channels 29, 29 (refer to FIG. 1), whereby the plating liquid 17 is caused to flow as a vortex along the circumferential wall 26*a*.

The support block 25 has attachment holes for accommodating four bolts 54 provided at regular intervals on the bottom part 26*b* of the depression 26, and also has a through-hole 25*a* that is formed in the center of the bottom part 26*b*.

The outside diameter of the inner member 27 is formed so as to be smaller than the inside diameter of the depression 26, and a depression 27*b* is formed in the center region. A bottom end protrusion 16*d* on the cylindrical electrode 16 inserts into the depression 27*b*, and a bottom end 16*e* of the cylindrical electrode 16 abuts a top surface 27*c* of the inner member 27.

The inner member 27 has through-holes for accommodating four bolts 54 provided at regular intervals. The through-hole 27*a* of the inner member 27 is formed on the inside of the depression 27*b*.

In the condition in which the inner member 27 is attached inside the depression 26 of the support block 25, a top surface 27*c* of the inner member 27 and a top surface 25*c* of the support block 25 lie in the same plane (refer to FIGS. 1 and 2).

The porous member 33, for example, is a ring-shaped plate composed of a plurality of mesh members formed from cotton in a network form. In other words, the porous member 33 is a member having a large number of holes (micropores) of a determinate size. The outer circumferential part 33*a* is disposed in a fitting groove 25*d* of the support block 25. The inner circumferential part 33*b* is disposed in a fitting groove 27*d* of the inner member 27. The porous member 33 covers the upper end 28*a* of the ring-shaped introduction channel 28 (refer to FIGS. 1 and 2).

A top surface 33*c* of the porous member 33, the top surface 27*c* of the inner member 27, and the top surface 25*c* of the support block 25 lie in the same plane in a state in which the outer circumferential part 33*a* of the porous member 33 is disposed in the fitting groove 25*d* of the support block 25, and the inner circumferential part 33*b* is disposed in the fitting groove 27*d* of the inner member 27 in this manner (refer to FIGS. 1 and 2).

The cylindrical electrode 16 has the through-hole 16*a* in the longitudinal direction, and has a bottom protrusion 16*d* on the bottom end 16*e*. The cylindrical electrode 16 has a step 56*a* and an inclined surface 56*b* on the inner circumferential part 56 of the upper end 16*b*.

Because the bottom end protrusion 16*d* inserts into the depression 27*b* of the inner member 27, the bottom end part 16*e* of the cylindrical electrode 16 abuts the top surface 27*c* of the inner member 27.

In this condition, the four bolts 54 insert into the attachment holes of the support block 25 and the attachment holes of the inner member 27. The support block 25, inner member 27, and cylindrical electrode 16 are joined together by causing the threaded parts 54*a* of the bolts 54 that protrude from the attachment holes of the inner member 27 to threadably engage the screw holes 16*f* of the cylindrical electrode 16 (refer to FIG. 2).

The shielding plate 35 is formed in the shape of a disk from an insulating material. As shown in FIG. 1, the outside diameter D1 of the shielding plate 35 is formed so as to be smaller than the inside diameter D2 of the inner circumferential wall 14 that forms the hollow region 12 of the cylinder 13. The shielding plate 35 has four attachment holes 61 formed in roughly the center region thereof.

The shielding plate 35 is attached to the upper end part 16*b* of the cylindrical electrode 16 via a plurality of stud bolds 58 that constitute the attachment means 36. The respective stud bolts 58 have shoulders 58*a* of height H1. The shoulders 58*a* have a thread 58*b* at the bottom ends thereof, and have screw holes 58*d* in the upper ends 58*c*.

Figure 4:
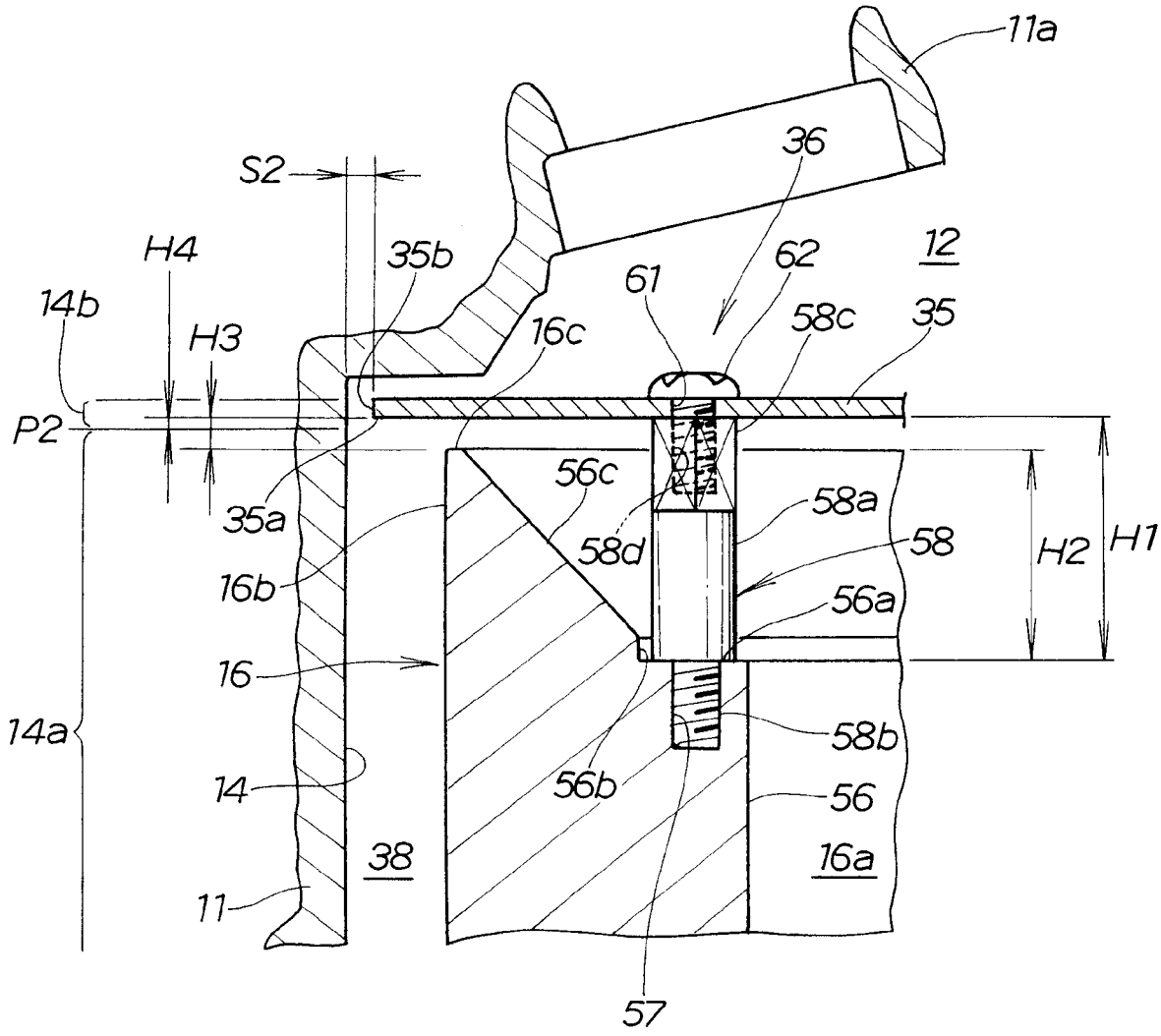
FIG. 4 is an enlarged view of region 4 of FIG. 1.

As shown in FIG. 4, the upper end 16*b* of the cylindrical electrode 16 is provided with a flat step 56*a* that is formed on the inner circumferential region 56 of the cylindrical electrode 16, and with an inclined surface 56*c* formed so that the surface gradually increases in diameter from the outer circumferential end 56*b* of the step region 56*a* toward the upper edge 16*c*. The height from the step 56*a* to the upper edge 16*c* is H2.

The shielding plate 35 is attached to the step region 56*a* via the attachment means 36. Specifically, the attachment means 36 is formed from four bolts 62 and four stud bolts 58 (only the two front bolts are shown in FIGS. 1 to 3).

Four screw holes 57 (only one is shown in the figures) are formed at regular intervals in the step region 56*a*, and the thread 58*b* of the stud bolts 58 is threadably engaged with the respective screw holes 57.

The shoulder regions 58*a* of the stud bolts 58 are at height H1. The height H1 is larger than the height H2 from the step region 56*a* to the upper end 16*c*. Specifically, the relationship H1>H2 is satisfied.

The shielding plate 35 is placed on the upper ends 58*c* of the stud bolts 58, and the bolts 62 are inserted into the attachment holes 61 of the shielding plate 35. The bolts 62 that protrude from the attachment holes 61 of the shielding plate 35 are threadably engaged with the screw holes 58*d* formed in the upper ends 58*c* of the stud bolts 58. By this means, the shielding plate 35 is attached to the upper ends 58*c* of the stud bolts 58.

The height H1 of the shoulder regions 58*a* of the stud bolts 58 is larger than the height H2 from the step regions 56*a* to the upper edge 16*c*. Therefore, the shielding plate 35 is attached above the upper edge 16*b* of the cylindrical electrode 16 (refer to FIG. 1 as well). A gap H3 is thereby formed between the upper edge 16*c* of the cylindrical electrode 16 and the shielding plate 35.

In this condition, a lower part 35*a* of the external circumferential end of the shielding plate 35 is disposed so that this part aligns with the plating boundary position (boundary position) P2 between the surface to be plated 14*a* and the plating boundary surface 14*b* (surface above the surface to be plated), or is disposed above the plating boundary position P2.

Figure 9:
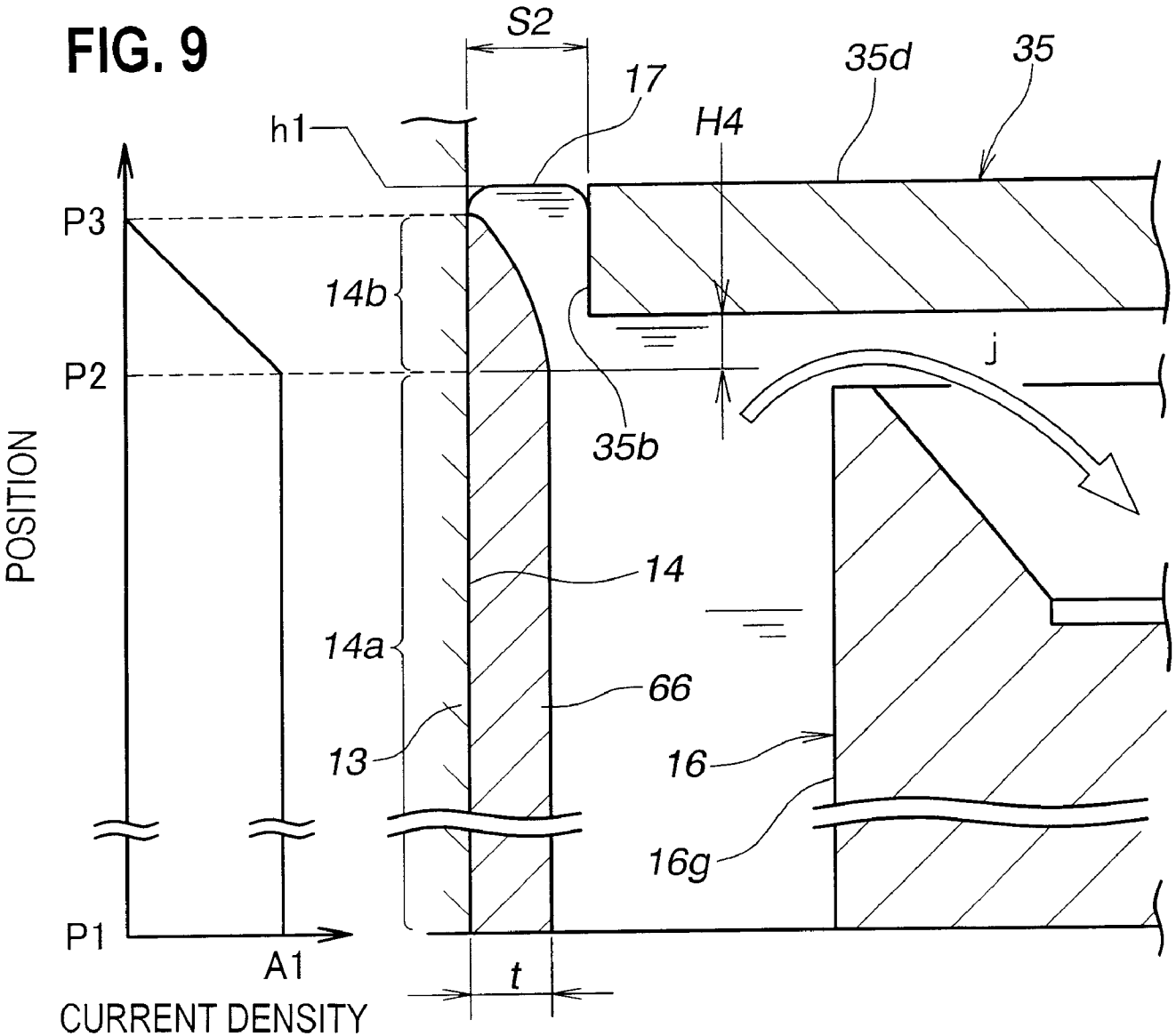
FIG. 9 is a schematic view showing a relationship between the plated coating and the shielding plate according to the first embodiment.

The term "surface to be plated 14*a*" refers to the surface of the inner circumferential wall 14 on which the plated coating 66 is to be formed (refer to FIG. 9).

The term "plating boundary surface 14*b*" refers to the surface above the surface to be plated 14*a*.

The lower part 35*a* of the external circumferential end of the shielding plate 35 is disposed so that this part aligns with the plating boundary position P2, or is disposed above the plating boundary position P2. The gap H4 between the lower part 35*a* of the external circumferential end of the shielding plate 35 and the plating boundary position P2 is set to 0 to 10 mm.

The reason that the gap H4 is set at 0 to 10 mm is discussed below.

Specifically, when the lower part 35*a* of the external circumferential end of the shielding plate 35 is disposed below the plating boundary position P2, forming the plated coating 66 up to the plating boundary position P2 is difficult to accomplish. Thus, H4 is set to 0 mm or greater so that the plated coating 66 can be formed up to the plating boundary position P2.

If the gap H4 exceeds 10 mm, on the other hand, then the lower part 35*a* of the external circumferential end of the shielding plate 35 will be too far above the plating boundary position P2, and there is the danger that the plated coating 66 will be formed outside the plating boundary position P2. Thus, the gap H4 is set to 10 mm or less in order to restrict formation of the plated coating 66 to the plating boundary position P2.

The shielding plate 35 is formed in the shape of a disk from an insulating material, and is a member that has an outside diameter D1 that is smaller than the inside diameter D2 of the inner circumferential wall 14 of the cylinder 13, as shown in FIG. 1. By this means, a gap S2 for introducing a plating liquid is formed between the inner circumferential wall 14 and the outer circumference 35*b* of the shielding plate 35. Specifically, the gap S2 for introducing a plating liquid is set at 0.25 to 5 mm.

The reason that the gap S2 for introducing a plating liquid is set at 0.25 to 5 mm is discussed below.

When the gap S2 for introducing a plating liquid is less than 0.25 mm, the gap S2 is too small, making it difficult for the plating liquid 17 to be conducted into the gap S2. If the plating liquid 17 is not conducted into the gap S2 for this reason, the result is equivalent to a condition whereby the external circumference 35*a* of the shielding plate 35 is in contact with the inner circumferential wall 14, and there is the danger that flash will be generated at the boundary region of the plated coating as described in the prior art. Consequently, the gap S2 for introducing a plating liquid is set to 0.25 mm or greater, thereby preventing generation of flash at the boundary region 66*a* of the plated coating 66.

If the gap S2 for introducing a plating liquid exceeds 5 mm, on the other hand, then the gap S2 will be too large, and there is the danger that plating liquid 17 will flow out from the gap S2. If the plating liquid 17 flows out from the gap S2, the plating liquid 17 frequently adheres to regions that are not to be plated. Moreover, the electric current density above the regions to be plated decreases, and the plating thickness in these regions decreases as well. As a result, the gap S2 for introducing a plating liquid is restricted to 5 mm or less, thereby preventing an outflow of the plating liquid 17 from the gap S2.

Because the shielding plate 35 is affixed to the cylindrical electrode 16, the shielding plate 35 can be affixed to the cylindrical electrode 16 by merely using a plurality of stud bolts 58 or bolts 62. Consequently, the members for attaching the shielding plate 35, i.e., the stud bolts 58 or bolts 62, allow the apparatus to be made simpler and smaller, and equipment costs to be reduced.

The method for forming the plated coating on the inner circumferential surface of the cylinder 13 using the plating apparatus 10 of the first embodiment is discussed below in reference to FIGS. 5 to 10.

Figure 5:
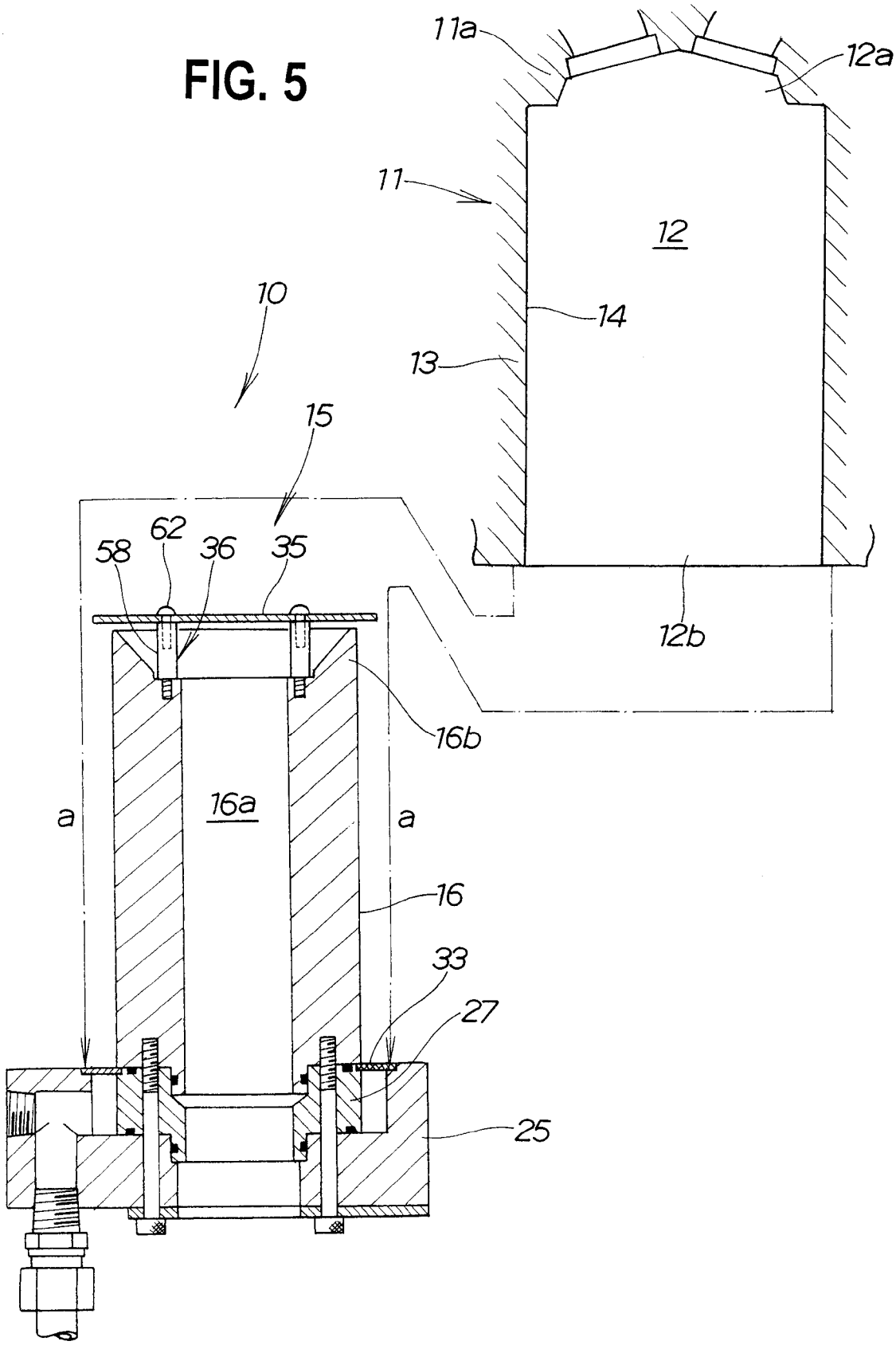
FIG. 5 is a sectional view showing an example in which the plating apparatus of the first embodiment is placed on a cylinder block.

FIG. 5 shows an example in which the cylinder block 11 is placed on the plating apparatus 10 of the first embodiment.

The cylinder block 11 is placed on the support block 25 of the electrode unit 15 as indicated by the arrow a. At this time, the cylindrical electrode 16 is disposed inside the hollow region 12 (refer to FIG. 1) so that the cylindrical electrode 16 is covered from the side of the bottom end (one end) 12*b* of the hollow region 12 in the cylinder 13.

The cylinder block 11 is formed with the cylinder head 11*a* integrated with the cylinder 13, and the upper end 12*a* of the hollow region 12 is closed off by the cylinder head 11*a*. For this reason, after placing the cylinder block 11 on the support block 25, the shielding plate 35 cannot be disposed at the prescribed location from the side of the upper end 12*a* of the hollow region 12.

As a result, the shielding plate 35 is affixed in advance to the upper end 16*b* of the cylindrical electrode 16. When the cylinder block 11 has been placed on the support block 25, it is possible to dispose the shielding plate 35 in the prescribed position from the side of the lower end 12*b* of the hollow region 12. Thus, it is possible to use the plating apparatus 10 for cylinder blocks 11 in which only the bottom end 12*b* of the hollow region 12 is open. Consequently, the range of application of the plating apparatus 10 is not restricted by the shape of the workpiece, allowing the apparatus to be used in a wider range of applications.

Figure 6A:
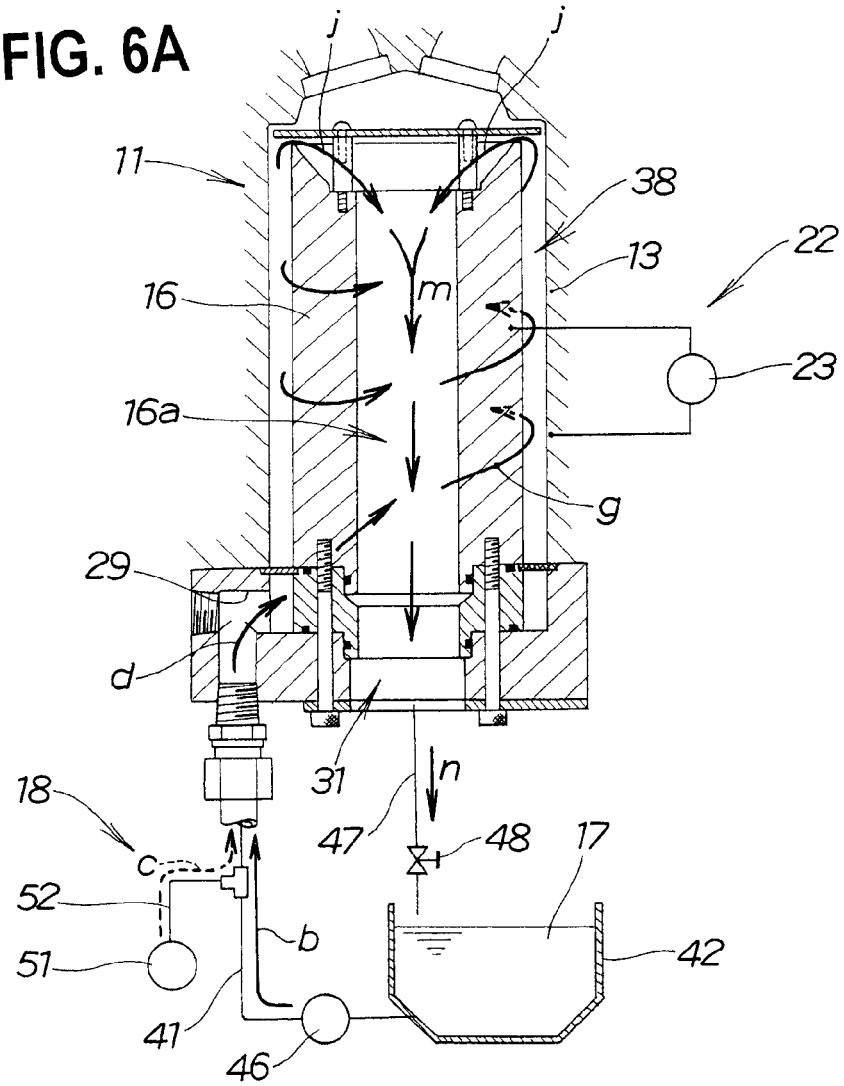
FIGS. 6A and 6B are schematic views showing an example in which a plating liquid is supplied by the plating liquid supply means according to the first embodiment.
Figure 6B:
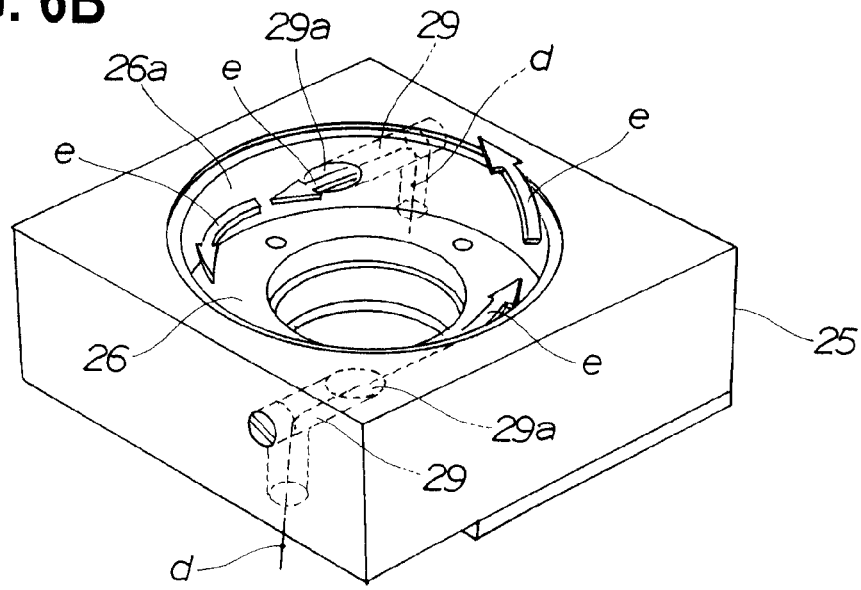

FIGS. 6A and 6B are examples wherein the plating liquid 17 is supplied by the plating liquid supply means 18 in the direction of the vortex-producing channel 29.

In FIG. 6A, the supply pump 46 is driven, whereby the plating liquid 17 in the tank 42 is conducted towards the vortex-producing channels 29, 29 (refer to FIG. 6B), as indicated by the arrow b, along the interior of the supply channel 41. Simultaneously, the air supply source 51 is driven to supply air to the supply channel 41 via the air supply channel 52, as indicated by the arrow c. Bubbles 65 (refer to FIG. 7A) are thereby produced by the air in the plating liquid 17 in the supply channel 41.

The plating liquid 17 having the bubbles 65 is conducted to the vortex-producing channels 29, 29 as indicated by the arrow d.

As shown in FIG. 6B, a pair of vortex-producing channels 29, 29 is formed parallel to a tangent to the circumferential wall 26*a* of the depression 26 formed in the support block 25. Consequently, the plating liquid 17 is supplied along the circumferential wall 26*a* of the depression 26 from the supply openings 29*a*, 29*a* of the vortex-producing channels 29, 29, and the plating liquid 17 flows in an arc along the circumferential wall 26*a* as indicated by the arrow e.

Figure 7A:
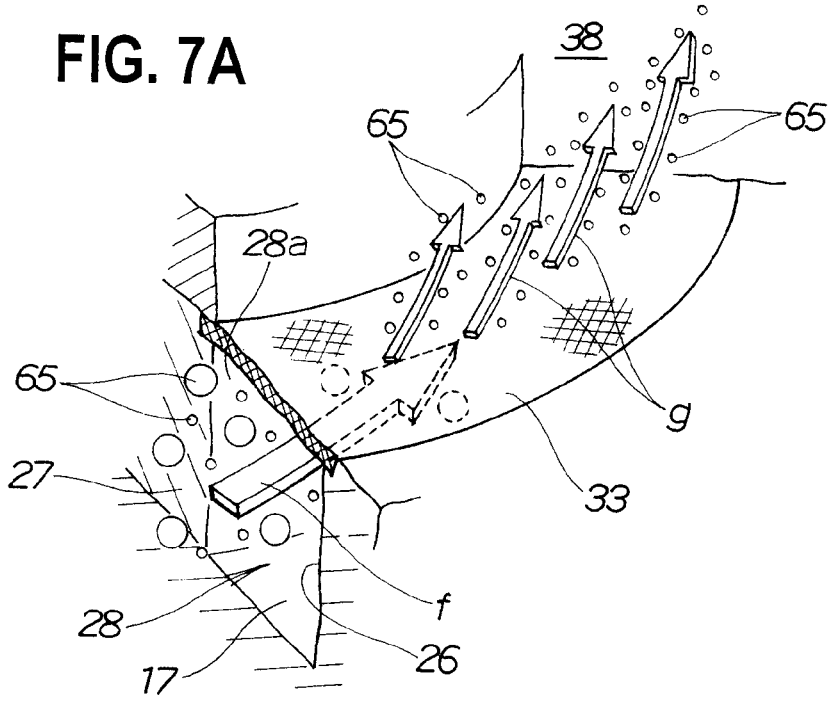
FIGS. 7*a* and 7B are schematic views showing the flow of the plating liquid.
Figure 7B:
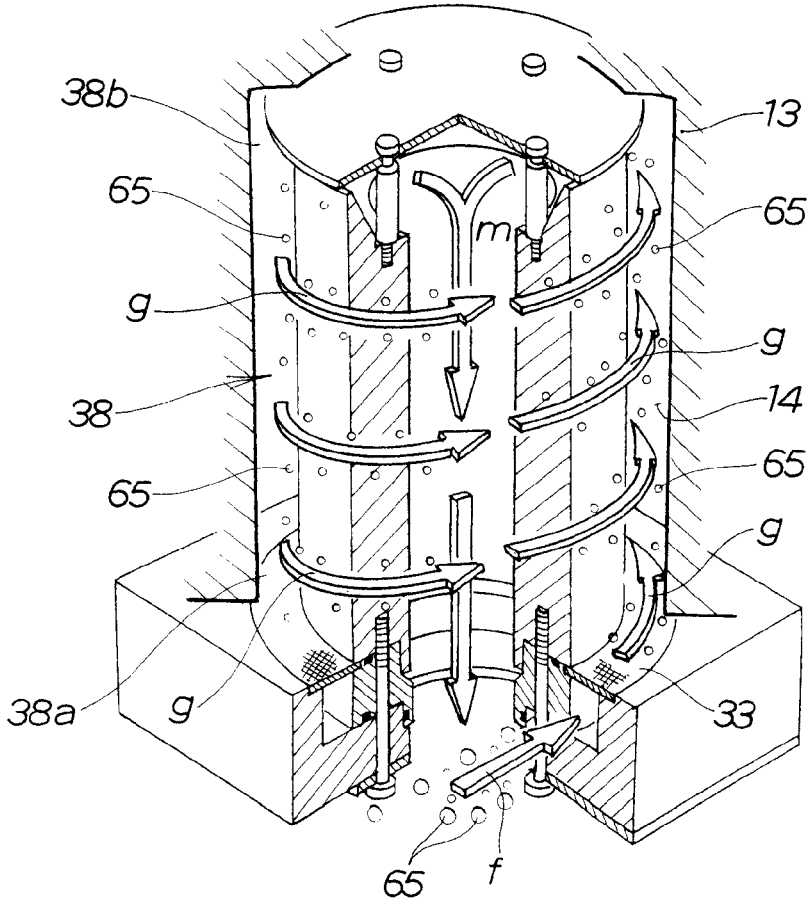

FIGS. 7A and 7B show the condition in which the plating liquid 17 flows inside the plating apparatus.

In FIG. 7A, the inner member 27 is disposed in the groove 26, whereby a ring-shaped introduction channel 28 is formed by the depression 26 and the inner member 27.

The plating liquid 17 having the bubbles 65 flows in an arc along the ring-shaped introduction channel 28. The plating liquid 17 that flows in an arc along the introduction channel 28 flows into the plating channel 38 via the porous member 33 provided at the upper end 28*a* of the introduction channel 28.

Thus, the plating liquid 17 in the introduction channel 28 tends to be focused as indicated by the arrow f. Because the plating liquid 17 is conducted into the plating channel 38 via the porous member 33, the flow of the plating liquid 17 is diffused as indicated by the arrows g, and the flow of the plating liquid 17 is adjusted to be uniform.

In addition, in the condition in which the air is supplied to the supply channel 41 from the air supply channel 52 (refer to FIG. 6A), the bubbles 65 in the plating liquid 17 are comparatively large, and the likelihood is high that the size thereof will not be uniform.

The plating liquid 17 having the bubbles 65 is conducted into the plating channel 38 via the porous member 33, whereby the bubbles 65 in the plating liquid 17 are made comparatively small, the size of the bubbles 65 is adjusted to be uniform, and the bubbles 65 are uniformly dispersed.

The uniformly dispersed plating liquid 17 flows upwards helically along the plating channel 38, as indicated by the arrows g in FIG. 7B. The plating liquid 17 includes the bubbles 65 that have been adjusted to be comparatively small and of uniform size.

The mixing of the plating liquid 17 is enhanced because the plating liquid 17 flows helically in the direction of the upper end 38*b* (upper end of the cylindrical gap) from the lower end 38*a* (lower end of the cylindrical gap) of the plating channel 38. Consequently, the plating liquid 17 flows uniformly through the plating channel 38. Thus, the plated coating 66 (refer to FIG. 9) is adequately formed at a uniform thickness over the entire inner circumferential wall 14 of the cylinder 13.

Figure 8A:
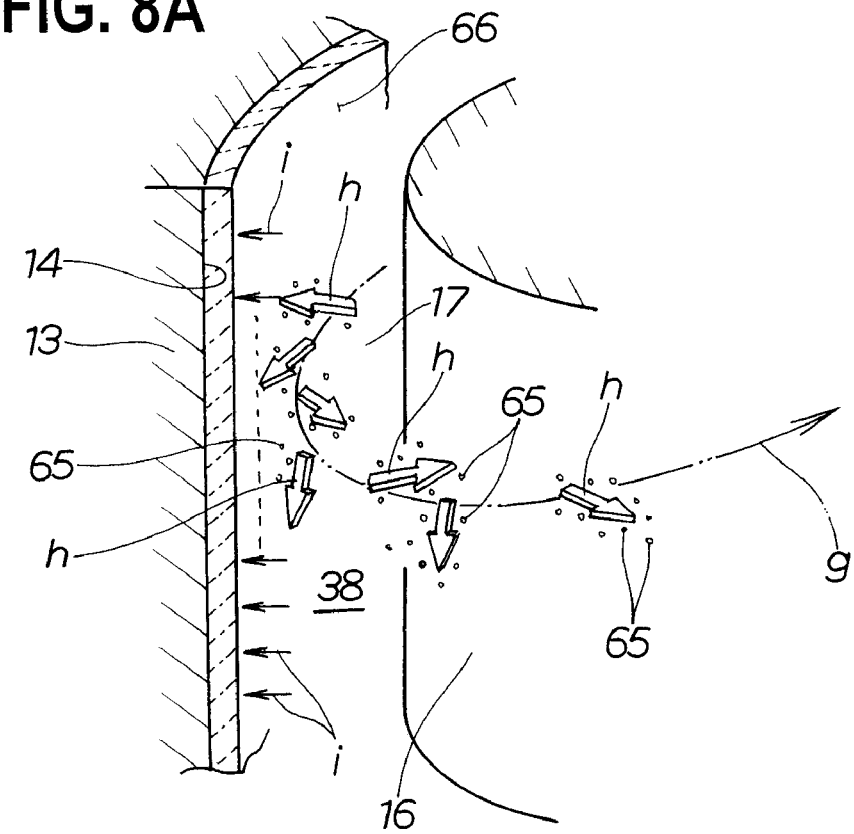
FIGS. 8A and 8B are schematic views showing a relationship between the plating liquid and bubbles.
Figure 8B:
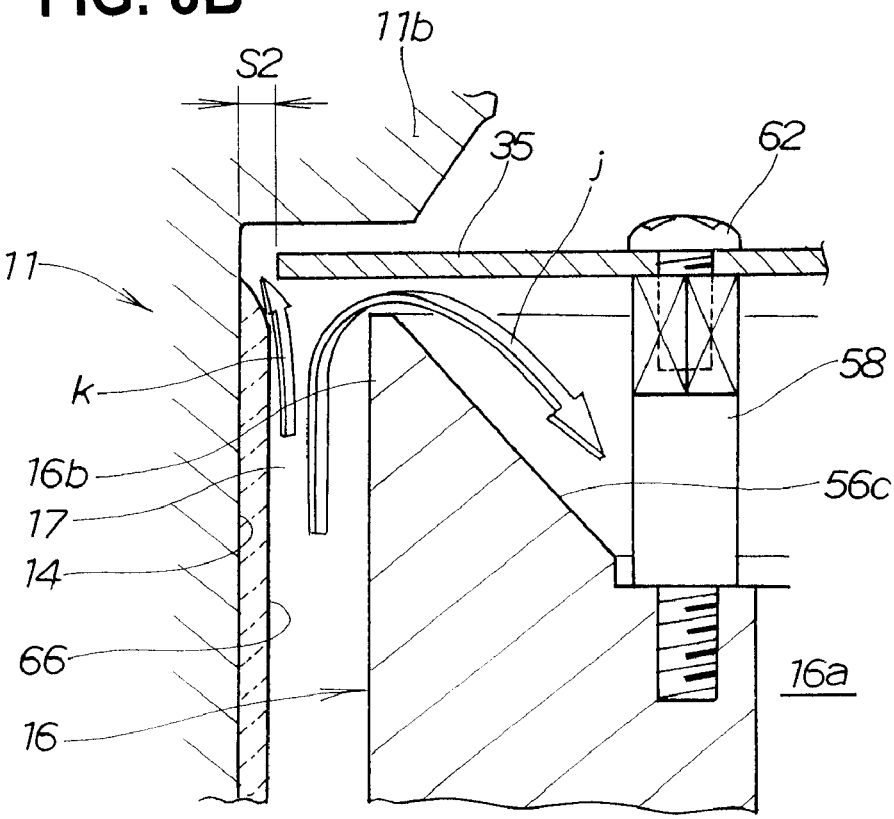

FIGS. 8A and 8B show the relationship between the plating liquid and bubbles.

In FIG. 8A, the bubbles 65 in the plating liquid 17 are comparatively small and the size of the bubbles 65 is made uniform, so that the bubbles 65 move smoothly inside the plating liquid 17. Consequently, the plating liquid 17 (i.e., the ceramic particles in the plating liquid 17) are mixed by the bubbles 65 as indicated by the arrows h.

The cylinder 13 and the cylindrical electrode 16 are energized by the electric current supply means 22 (refer to FIG. 6A). Thus, the plating components in the plating liquid 17, as indicated by the arrow i, are uniformly conducted over the entire inner circumferential wall 14 of the cylinder 13, allowing more favorable formation of plated coating 66 at a uniform thickness over the entire inner circumferential wall 14.

Moreover, the plating liquid 17 is dispersed by the porous member 33 (refer to FIG. 7A), and the flow of the plating liquid 17 is adjusted to be uniform by the porous member 33, so that the plating components in the plating liquid 17 are conducted uniformly over the entire inner circumferential wall 14 of the cylinder 13, allowing more favorable formation of the plated coating 66 at a uniform thickness over the entire inner circumferential wall 14.

In FIG. 8B, most of the plating liquid 17 that reaches the upper end 16*b* of the cylindrical electrode 16 is guided by the shielding plate 35 and introduced into the cylindrical electrode 16 as indicated by the arrow j. The plating liquid 17 that has flown into the cylindrical electrode 16 is conducted to the through-hole 16*a* of the cylindrical electrode 16.

Meanwhile, the remainder of the plating liquid 17 that has reached the upper end 16*b* of the cylindrical electrode 16 enters the gap S2 for introducing the plating liquid between the shielding plate 35 and the inner circumferential wall 14 as indicated by the arrow k.

Because the gap S2 is kept at 5 mm or less, an outflow of the plating liquid 17 from the gap S2 is prevented.

As shown in FIG. 6A, the plating liquid 17 that has entered the through-hole 16*a* in the cylindrical electrode 16 flows as indicated by the arrow m and enters the return channel 47 via the outflow channel 31. The plating liquid 17 that has reached to the return channel 47 as indicated by the arrow n returns to the tank 42 via the control valve 48.

Thus, if there is an appropriate flow of the plating liquid 17, the condition shown in FIG. 9 is produced even without being controlled by the control valve 48. Specifically, the liquid surface height hi of the plating liquid 17 in the gap S2 for introducing the plating liquid can be made approximately equivalent to the upper surface 35*d* of the shielding plate 35.

If the liquid surface height h1 of the plating liquid 17 in the gap S2 for introducing the plating liquid should be different from the top surface 35*d* of the shielding plate 35, the height can be adjusted by the control valve 48, and the liquid surface height h1 can thereby be made to approximately correspond with the upper surface 35*d* of the shielding plate 35.

FIG. 9 shows the relationship between the shielding plate 35 and the plated coating 66.

In the condition in which the plating liquid 17 has been introduced into the gap S2 for introducing the plating liquid between the inner circumferential wall 14 and the outer circumference 35*b* of the shielding plate 35, the cylindrical electrode 16 and the cylinder 13 are energized by the electric current supply means 22 (refer to FIG. 6*a*).

In this condition, a constant value A1 is maintained for the electric current density between the plating boundary position P2 and the lower end position P1 of the cylinder 13, and the electric current density between the plating boundary position P2 and the plating upper limit position P3 is made to decrease gradually from the plating boundary position P2 toward the plating upper limit position P3.

The region between the lower end position P1 and the plating boundary position P2 of the cylinder is designated "the surface to be plated 14*a*," and the region between the plating boundary position P2 and the plating upper limit position P3 is designated "the plating boundary surface 14*b*."

The surface 16*g* of the cylindrical electrode 16 is opposite and parallel with respect to the surface to be plated 14*a* on the inner circumferential wall 14. As a result, the electric current density with respect to the surface to be plated 14*a* is maintained at a constant value A1, and a constant plating thickness t can be ensured for the plated coating 66 formed on the surface to be plated 14*a*.

On the other hand, the shielding plate 35 is disposed in alignment with the plating boundary position P2 above the plating boundary position P2. This shielding plate 35 is composed of an insulating material. Thus, at the plating boundary surface 14*b*, the electric current density decreases gradually from the plating boundary position P2 toward the plating upper limit position P3, and becomes zero at the plating upper limit position P3.

By this means, the plating thickness t of the plated coating 66 decreases gradually from the plating boundary position P2 toward the plating upper limit position P3 at the plating boundary surface 14*b*, and becomes 0 at the plating upper limit position P3.

A uniform plating thickness t can thereby be ensured for the plated coating 66 on the surface to be plated 14*a*. In addition, because the plating thickness t of the plated coating 66 decreases gradually at the plating boundary surface 14*b*, an adequate plated coating 66 can be formed.

It is thus possible to prevent separation of the plated coating 66 from the boundary region 66*a* during machining of the surface of the plated coating 66.

In addition, by providing the shielding plate 35, rising of the plating liquid 17 above the plating surface 14*a* is inhibited by the shielding plate 35. The plated coating 66 can thereby be reliably formed only on the surface to be plated 14*a* where the plated coating 66 is necessary.

Figure 10:
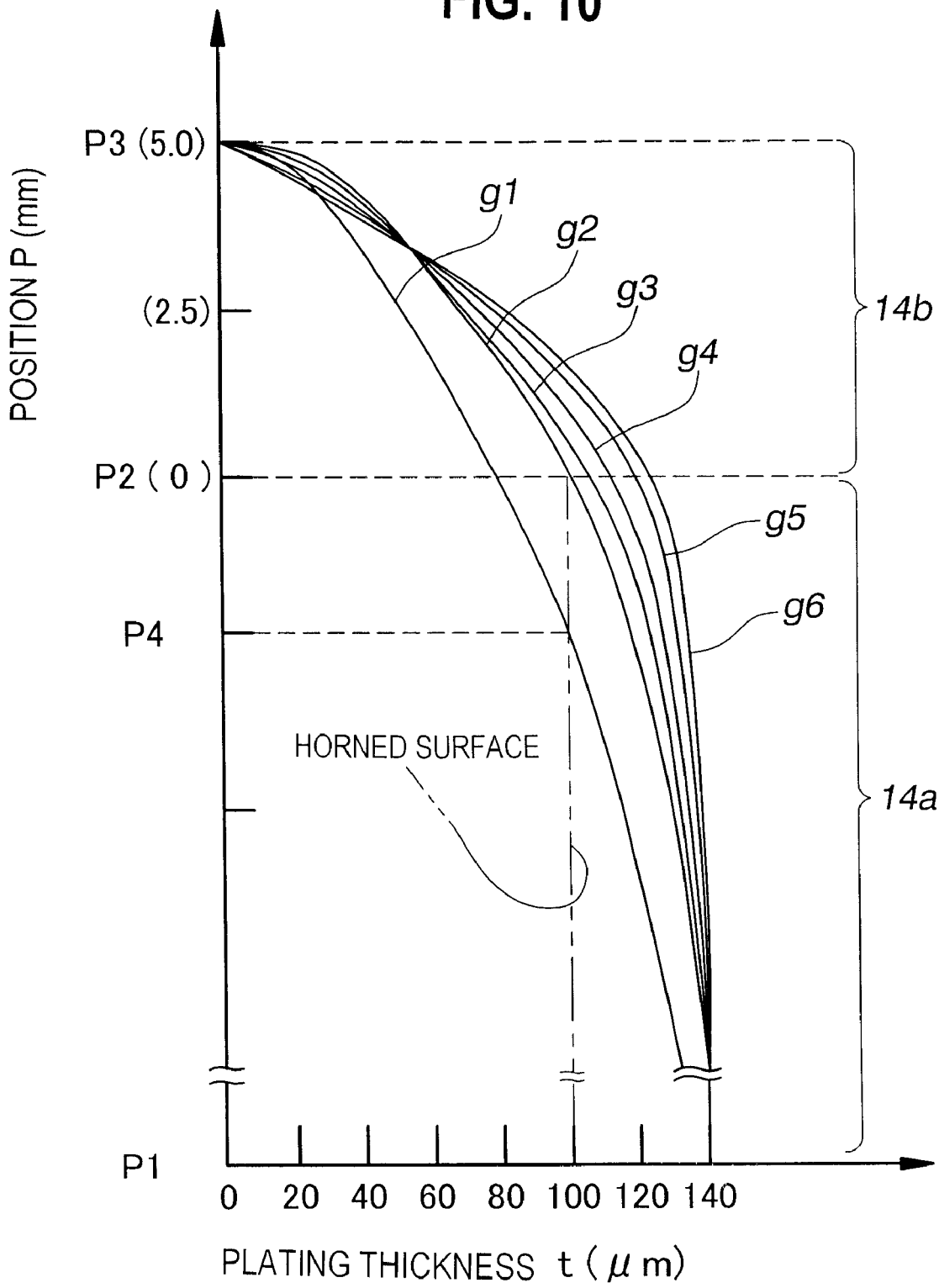
FIG. 10 is a graph showing a relationship between the shielding plate and the plated coating.

FIG. 10 is a graph showing the relationship between the position of the shielding plate and the thickness of the plated coating. The vertical axis represents the position P (mm) on the inner circumferential wall of the cylinder, and the horizontal axis represents the plating thickness t (μm). In regard to the position P on the vertical axis, the region between the plating boundary position P2 and the lower end position P1 on the cylinder is designated "the surface to be plated 14*a*," and the region between the plating boundary position P2 and the plating upper limit position P3 is designated "the plating boundary surface 14*b*."

The graph g1 shows a condition in which a shielding plate 35 is not provided at the plating boundary position P2 (refer to FIG. 9).

Graph g2 shows an example in which a plated coating is formed in a condition in which the gap H4 shown in FIG. 9 is 1 mm and the gap S2 for introducing a plating liquid is set to 5 mm.

Graph g3 shows an example in which a plated coating is formed in a condition in which the gap H4 is 1 mm and the gap S2 for introducing a plating liquid is set to 3 mm.

Graph g4 shows an example in which a plated coating is formed in a condition in which the gap H4 is 1 mm and the gap S2 for introducing a plating liquid is set to 2 mm.

Graph g5 shows an example in which a plated coating is formed in a condition in which the gap H4 is 1 mm and the gap S2 for introducing a plating liquid is set to 1 mm.

Graph g6 shows an example in which a plated coating is formed in a condition in which the gap H4 is 1 mm and the gap S2 for introducing a plating liquid is set to 0.25 mm.

The gap H4 is a gap between the plating boundary position P2 and the lower part 35*a* of the external circumferential end of the shielding plate 35. The gap S2 for introducing a plating liquid is a prescribed gap between the external circumference 35*b* of the shielding plate 35 and the inner circumferential wall 14.

The average plating thickness t after the honing process is preferably maintained, for example, at 100 μm (indicated by the broken line) at the surface to be plated 14*a* on the inner circumferential wall 14 of the cylinder 13.

Plated coatings 66 were formed under the aforementioned conditions of graphs g1, g2, g3, g4, g5, and g6, and an evaluation was made as to whether 100 μm was maintained for the plating thicknesses t at the surfaces to be plated 14*a*.

The results of the evaluation were made by assigning a judgment of favorable for coatings that were maintained at 100 μm and a judgment of unfavorable for coatings not so maintained.

In graph g1, the average plating thickness could not be maintained at 100 μm in the region between the plating boundary position P2 and the position P4 under the plating boundary position P2. Specifically, in graph g1, 100 μm could not be ensured over the entire region of the surface to be plated 14*a*. Graph g1 thus provided an evaluation of unfavorable.

In graph g2, 100 μm was maintained on the surface to be plated 14*a*. Graph g2 thus provided an evaluation of favorable.

In graph g3, as with graph g2, 100 μm was maintained on the surface to be plated 14*a*. Graph g3 thus provided an evaluation of favorable.

In graph g4, as with graph g2, 100 μm was maintained on the surface to be plated 14*a*. Graph g4 thus provided an evaluation of favorable.

In graph g5, as with graph g2, 100 μm was maintained on the surface to be plated 14*a*. Graph g5 thus provided an evaluation of favorable.

In graph g6, as with graph g2, 100 μm was maintained on the surface to be plated 14*a*. Graph g6 thus provided an evaluation of favorable.

From graphs g2, g3, g4, g5, and g6, it was concluded that a thick plated coating could be increasingly ensured as the gap S2 for introducing a plating liquid decreased.

It was thus confirmed that an evaluation of favorable was obtained when the aforementioned tests were carried out with the gap H4 in the range of 0 to 100 mm and the gap S2 for introducing a plating liquid in the range of 0.25 to 5 mm.

Next, the plating apparatus according to the second embodiment will be discussed in reference to FIG. 11. In the plating apparatus of the second embodiment, the same designations are assigned to the same members as in the plating device of the first embodiment, and descriptions thereof are omitted. The plating apparatus 70 according to the second embodiment, is different from the plating apparatus 10 of the first embodiment shown in FIG. 4 only in terms of the shielding plate 71, but the rest of the structure is the same as that of the plating apparatus 10 according to the first embodiment.

Figure 11:
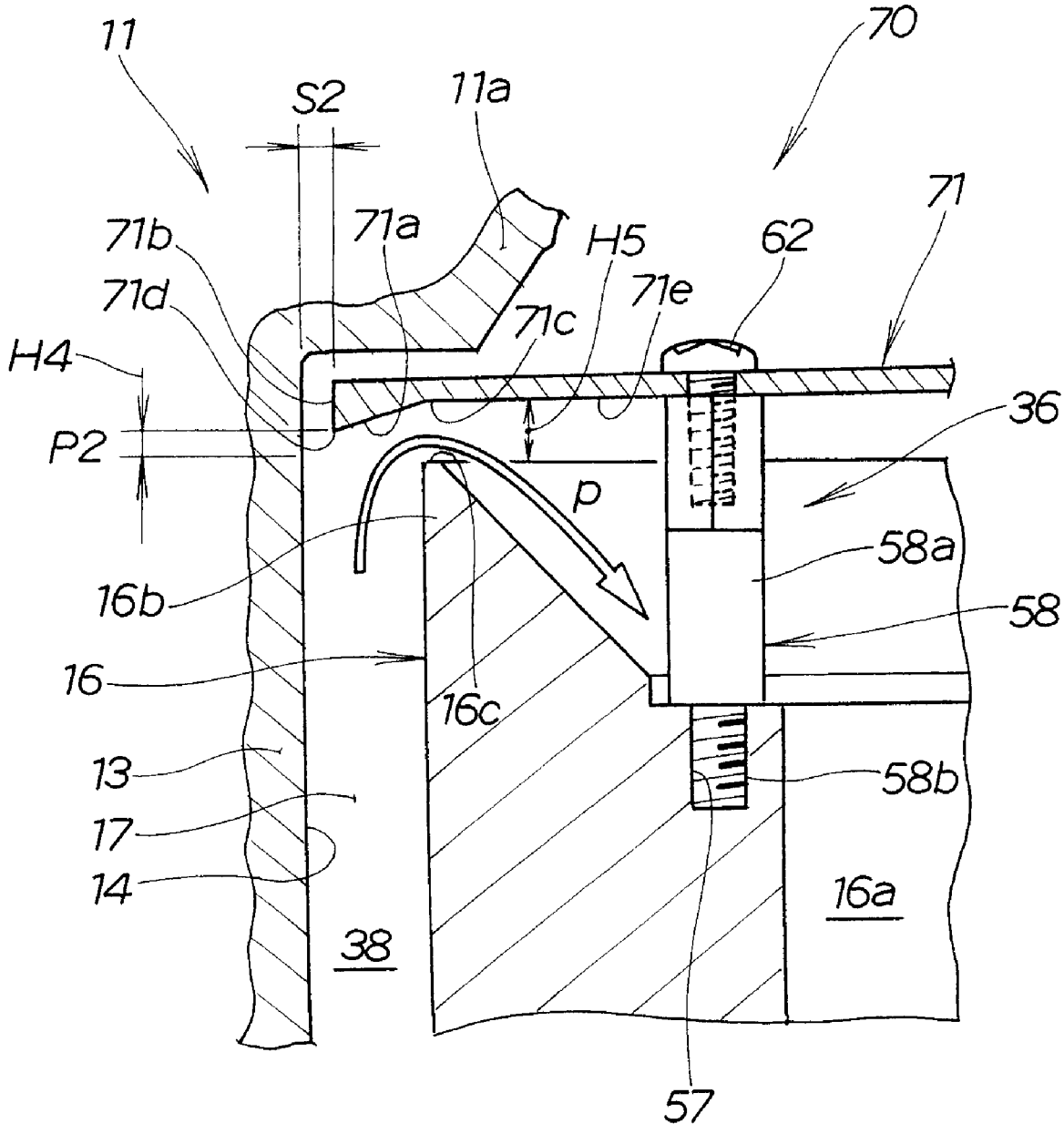
FIG. 11 is a sectional view showing the plating apparatus according to a second embodiment of the present invention.
Figure 12:
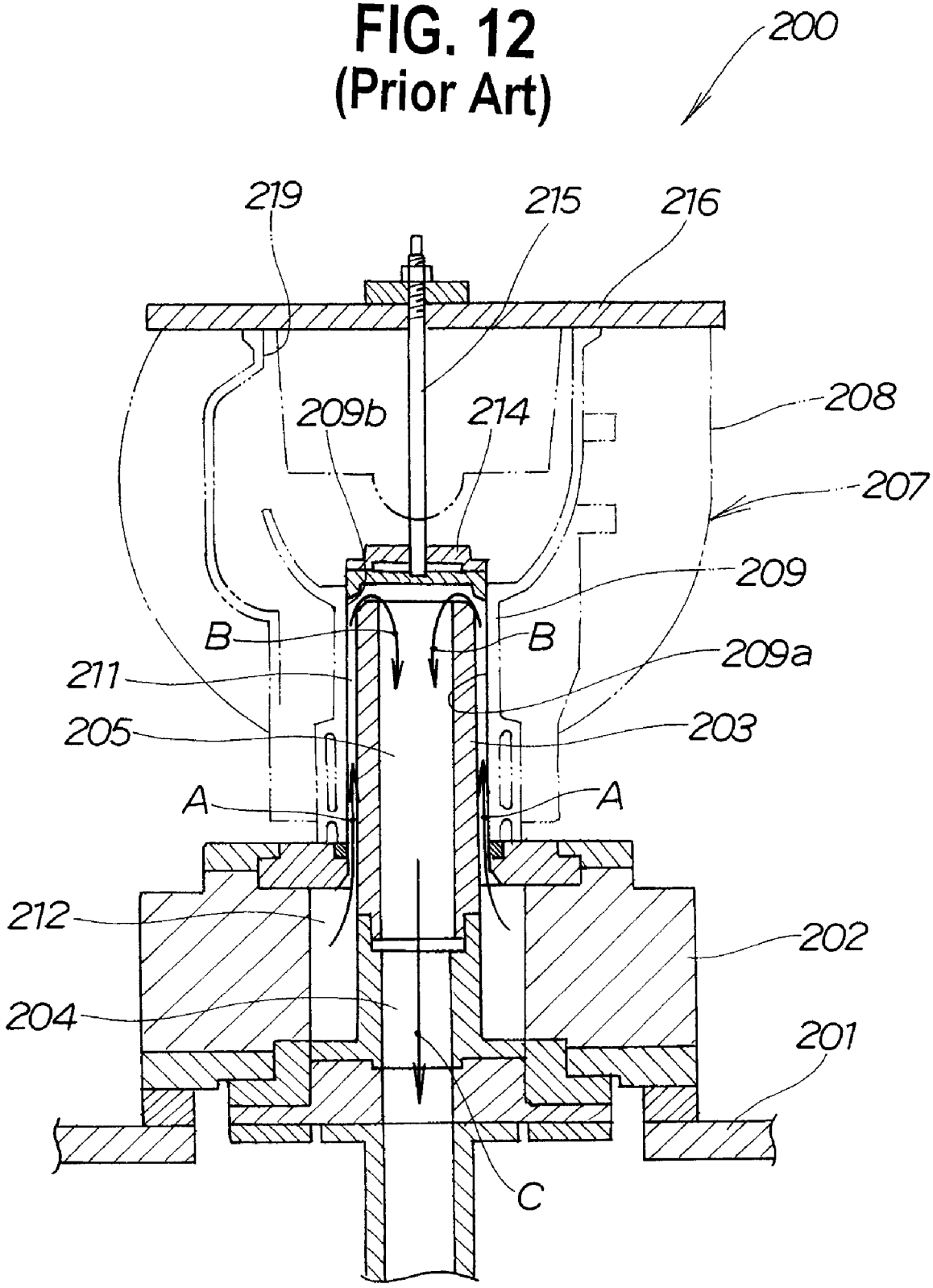
FIG. 12 (Prior Art)
FIG. 12 is a sectional view showing a conventional plating apparatus.
Figure 13A:
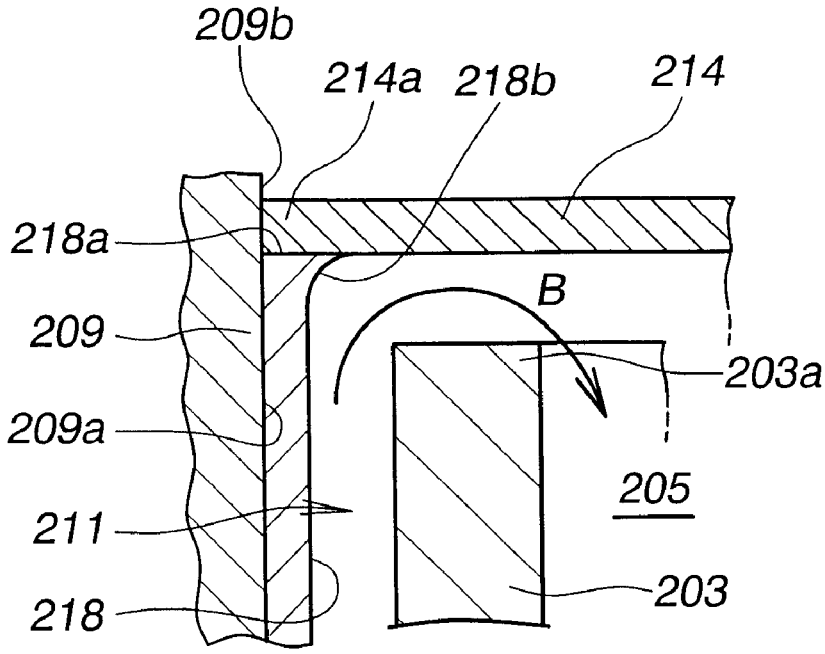
FIG. 13A (Prior Art)
FIGS. 13A and 13B are schematic views showing a state in which the plated coating is formed by the conventional high-speed plating apparatus of FIG. 12.
Figure 13B:
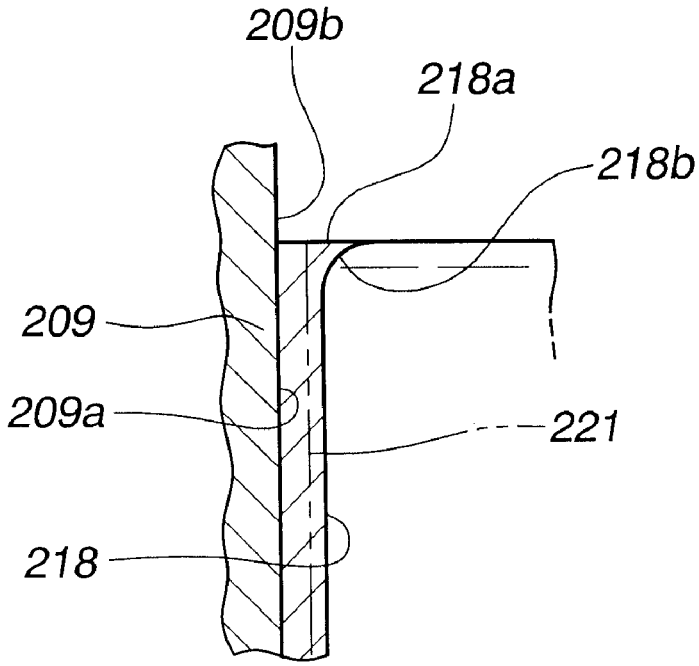
FIG. 13B (Prior Art)

The plating apparatus 70 of the second embodiment shown in FIG. 11 has an insulating shielding plate (shielding member) 71 that is attached via the attachment means 36 above the upper end 16*b* (over the upper end) of the cylindrical electrode 16. The lower external circumferential surface 71*a* of the shielding plate 71 is formed so that there is an inclined surface that slants downwards from a proximal location 71*c* of the outer circumference 71*b* towards the region below the outer circumferential end 71*d*. In other words, the region below the external circumferential end 71*d* is disposed below the lower surface 71*e* of the shielding plate 71. Consequently, when the region below the external circumferential end 71*d* is disposed at a gap H4 (0 to 10 mm) from the plating boundary position P2, a large gap H5 can be ensured between the upper edge 16*c* of the cylindrical electrode 16 and the lower surface 71*e* of the shielding plate 71.

Consequently, the plating liquid 17 that has reached the upper end 16*b* of the cylindrical electrode 16 is guided by the shielding plate 71 and is conducted more smoothly from the gap H5 to the through-hole 16*a* in the cylindrical electrode 16, as indicated by the arrow p.

In the first and second embodiments, the shielding members were described as shielding plates 35 and 71, but this is not the only possible option. The member may also have other shapes such as a block shape, and a device produced by combining a plurality of members may also be used.

In the first and second embodiments, the workpieces were described as cylinder blocks 11, but this is not the only possible option. Any workpiece can be used as long as the workpiece has a hollow region 12 wherein at least one end of the hollow region 12 is open.

Moreover, in the first and second embodiments, cases were described in which the workpiece was a cylinder block 11 having an integrated cylinder head 11*a*, but this is not the only possible option. The device may be used with types of workpieces in which the cylinder head 11*a* is separated from the cylinder block 11, i.e., with workpieces in which both ends of the hollow region 12 are open.

In the first and second embodiments, cases were described in which shielding plates 35, 71 were attached to a cylindrical electrode 16, but this is not the only possible option. The invention may also have a configuration in which, as in the prior art, the shielding plates 35 and 71 are detached from the cylindrical electrode 16.

Moreover, in the first and second embodiments, cases were described in which the plating liquid 17 flowed from the bottom to the top side in the gap S1, and the plating liquid 17 that had reached the upper end 16*b* of the cylindrical electrode 16 was conducted to the through-hole 16*a* by the shielding plate 35. However, the flow of the plating liquid is not restricted to this option alone. For example, the plating liquid 17 can also flow from the through-hole 16*a* to the gap S1, and a plurality of small-diameter through-holes may be formed in the wall surface of the cylindrical electrode 16, allowing the plating liquid in the through-holes 16*a* to pass through the small-diameter through-holes and to flow into the gap S1. In brief, a configuration may be produced in which the plating liquid 17 flows into the gap S1.

In the first and second embodiments, the plated coating 66 was formed using a plating liquid 17 that was produced by mixing bubbles 65 with the plating liquid 17, but this is not the only possible option. The plated coating 66 may be formed using a plating liquid not having admixed bubbles 65.

INDUSTRIAL APPLICABILITY

The present invention can be used in plating apparatuses for forming plated coatings on the inner circumferential walls of cylinders.

The invention claimed is:

1. A plating apparatus for forming a plated coating on an inner circumferential wall of a hollow region of a hollow workpiece, said apparatus comprising:

a cylindrical electrode having a longitudinal through-hole and disposed in such a manner as to form a cylindrical gap inside the hollow region of the workpiece;

means for forming a helical flow of a plating liquid from a bottom end to a top end of the cylindrical gap when the plating liquid flows into the cylindrical gap communicating with the through-hole via the end portion of the cylindrical electrode;

a supply channel for supplying a plating liquid through to a bottom end of the cylindrical gap;

a porous member having a plurality of holes provided between the supply channel and the bottom end of the gap; and air supply means provided in the supply channel, wherein air is supplied to the supply channel by the air supply means, whereby bubbles are admixed in the plating liquid in the supply channel, and the plating liquid with admixed air bubbles is conducted to the cylindrical gap via the porous member.

2. A plating apparatus for forming a plated coating on an inner circumferential wall of a hollow region of a hollow workpiece, said apparatus comprising:

a cylindrical electrode having a longitudinal through-hole and disposed in such a manner as to form a cylindrical gap inside the hollow region of the workpiece;

means for forming a helical flow of a plating liquid from a bottom end to a top end of the cylindrical gap when the plating liquid flows into the cylindrical gap communicating with the through-hole via the end portion of the cylindrical electrode;

a shielding member formed from an insulating material provided at an upper end of a hollow region of the workpiece; and a gap for introducing a plating liquid whereby the plating liquid can be introduced between the inner circumferential wall of the hollow region and the shielding member.

3. The plating apparatus of claim 2, wherein the shielding member is attached to the cylindrical electrode.

4. The plating apparatus of claim 2, wherein a bottom part of an outer circumferential end of the shielding member is disposed in proximity to the boundary position between a surface to be plated with the plated coating and a surface above the surface to be plated, and the gap for introducing the plating liquid is set to 0.25 to 5 mm.

5. The plating apparatus of claim 4, wherein the shielding member is attached to the cylindrical electrode.

* * * * *